United States Patent [19]

Tomburo et al.

[11] Patent Number: 4,521,127

[45] Date of Patent: Jun. 4, 1985

[54] SEALED PROPULSION MECHANISM FOR A STICK-DEODORANT OR THE LIKE CONTAINER

[75] Inventors: Anthony F. Tomburo, Cranford; Nicholas W. Kachur, Clark, both of N.J.

[73] Assignee: Gibson Associates, Inc., Cranford, N.J.

[21] Appl. No.: 445,429

[22] Filed: Nov. 30, 1982

[51] Int. Cl.[3] ..... A45D 40/06

[52] U.S. Cl. ..... 401/68; 401/75; 401/171; 401/175

[58] Field of Search ..... 401/175, 68, 79, 172, 401/75, 171, 174

[56] References Cited

U.S. PATENT DOCUMENTS

| | | | |
|---|---|---|---|
| 2,818,167 | 12/1957 | McKinley | 401/75 |
| 3,907,441 | 9/1975 | Idec et al. | 401/75 |
| 4,369,158 | 1/1983 | Woodruff et al. | 401/175 |

FOREIGN PATENT DOCUMENTS

| | | | |
|---|---|---|---|
| 1029992 | 2/1956 | Fed. Rep. of Germany | 401/175 |

*Primary Examiner*—Steven A. Bratlie

*Attorney, Agent, or Firm*—Hopgood, Calimafde, Kalil, Blaustein & Judlowe

[57] ABSTRACT

The invention contemplates sealed lead-screw propulsion mechanism for the piston of a container for stick deodorant or the like substance, wherein the container must be filled by hot melted substance which becomes the stick after it has been allowed to cool. The seal is operative when the piston is in its lower-most position within the container, so that liquid (melted) substance cannot seep through the region of lead-screw engagement to the piston. Once the substance has solidified, there is no further need for the seal, beyond retention of aromatic ingredients, i.e., until the product has reached the ultimate consumer; and the seal is operable only upon first dispensing use of the container.

8 Claims, 6 Drawing Figures

SEALED PROPULSION MECHANISM FOR A STICK-DEODORANT OR THE LIKE CONTAINER

BACKGROUND OF THE INVENTION

The invention relates to stick-deodorant or the like containers wherein the deodorant substance is loaded against a piston within the bore of an elongate housing, and wherein a base-operating member is exposed for rotation at the lower end of the housing and drives the piston via an upstanding threaded stem which is part of the base-operating member.

The deodorant or the like substance which must be loaded into such a container is melted by heat and poured as a liquid into the open upper end of the housing, being thereafter allowed to solidify into a stick, upon cooling to ambient temperature. The melted substance is of low viscosity and therefore has a tendency to leak through the region of stem-thread engagement to the piston, so that various measures have been adopted to minimize the involved loss of dispensable substance and the unsightliness of substance that may have exuded via clearance needed for rotary actuation of the base-operating member.

Among the techniques adopted to reduce such leakage is to design the thread engagement to be full at and near the down-position limit of the piston, and to provide for ratcheting engagement of the piston to the lead screw or stem when in the down-position limit, the ratchet engagement being desired to assure against inadvertent piston displacement due to vibration in the course of handling and transportation, from the container manufacturer to the filling house. Typically, the ratchet formations may have an angular distribution of six teeth poised for axially confronting engagement at the down position of the piston, and the thread engagement may be characterized by a triple lead of 0.0625-inch pitch threads, meaning a piston advance of 0.1875-inch, for each full rotation of the base-actuating member. However, even with the indicated measures, and even with special provision for chilling the poured substance, there are such adverse combinations of departure from exact fit of the parts that leakages continue to plague the filling house.

BRIEF STATEMENT OF THE INVENTION

It is an object to provide improved mechanism in a container of the character indicated, for eliminating leakage problems of the character indicated.

A specific object is to provide seal action in such a mechanism, the seal being effective regardless of adverse combinations of tolerance variation in threadedly engaged parts.

Another specific object is to provide improved ratchet action to retain the down-limiting position of the piston, with full circumferentially continuous loading of the sealed relation.

A further specific object is to achieve the above objects with minimum modification of existing container dies and with no loss of volumetric capacity of a given container size.

The invention achieves the above objects by providing circumferentially continuous axially confronting seal formations on the underside of the piston and at the base end of the threaded stem of a container of the character indicated. The seal formations take various forms but in every case provide a downward projection from the underside of the piston, axially engageable with a smooth annular surface of the stem at the down position. Ratchet action is such as to retain any one of a large plurality of angular positions of the piston with respect to the stem, the plurality being in such subdivision of a single turn of thread action as to provide plural ratchet escapements in the course of compressionally loading the seal, thus assuring retention of axially compressionally loaded seal action. The seal is so effective as to prevent leakage and to avoid the need for special chilling of filled containers, so that cooling to ambient temperature may occur in inventory or in transport, as long as filled containers are kept upright.

DETAILED DESCRIPTION

The invention will be illustratively described in detail in conjunction with the accompanying drawings, in which.

Figure 1:
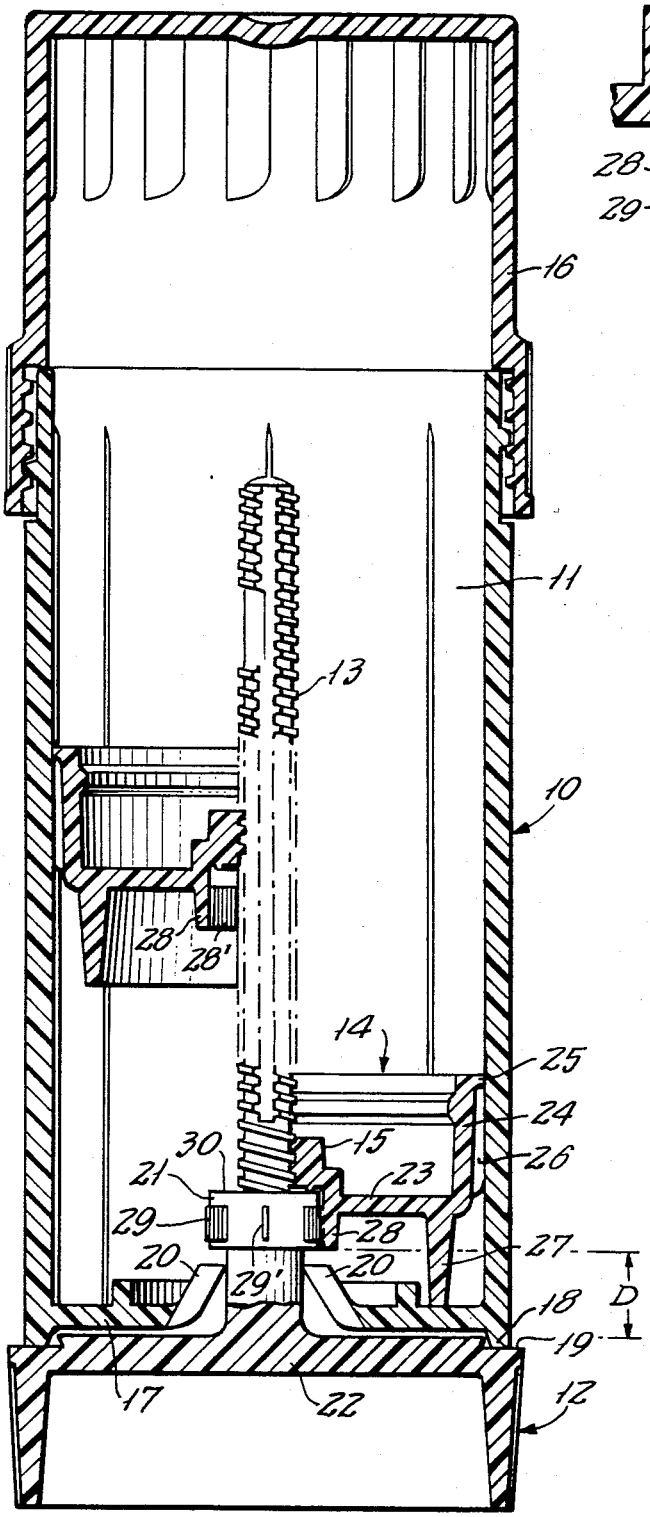
FIG. 1 is a longitudinal sectional view of a container of the invention, the piston portion being shown as separate half sections, and at different elevations, to better show its construction.

The container of FIG. 1 comprises three parts having propulsion coaction, namely, an elongate tubular housing 10 having a cylindrical bore 11, a base-operating member 12 supported for rotation at the closed lower end of housing 10 and having an upstanding threaded stem 13 extending within housing 10, and a piston member 14 with a hub 15 in threaded engagement to stem 13. A closure cap 16 is removably threaded to the open upper end of housing 10. Each part is of injection-molded plastic, the material of piston 14 being suitably polyethylene, and more compliant than the material (suitably ABS, or polypropylene) of the other parts.

The lower end of housing 10 includes a bottom wall 17 slightly recessed from a rim 18 which derives thrust-bearing support from a radial shoulder 19 of base member 12. The central region of wall 17 has plural axially compliant radially inward fingers 20 having snap-locking engagement beneath a cylindrical flange 21 at the lower end of the threads of stem 13 and at offset D from the web 22 of base member 12; snap-locking will be understood to occur as housing 10 is first assembled to base member 12, via stem 13, whereby these parts are self-retaining.

Piston member 14 is characterized by a web 23 and upper skirt 24 to define an upwardly open cup for reception of deodorant or the like filling substance (not shown). A circumferentially continuous lip 25 and plural angularly spaced ribs 26 engage the bore 11 for peripherally sealed and axially stabilized piloted support of the piston member 14 throughout its range of threaded advance on stem 13. Dependent from web 23 is an outer skirt 27 which abuts housing web 17 to determine the lowermost position of piston member 14. Finally, an inner and shorter skirt 28 depends from the hub region of piston 14, being sized for telescoping reception of the stem flange 21 when in the lowermost position.

Figure 2:
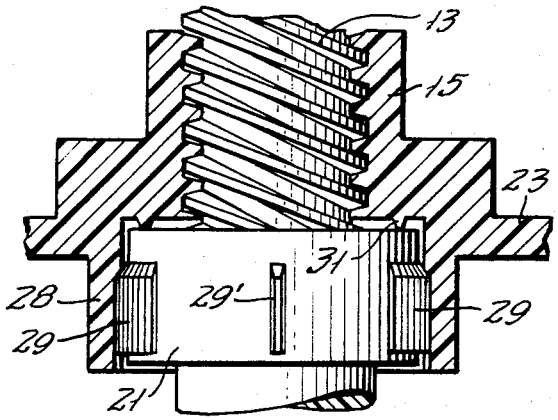
FIG. 2 is an enlarged fragmentary longitudinal sectional view of coacting seal and ratchet-engageable components of FIG. 1.

In accordance with the invention, and with additional reference to FIG. 2, flange 21 is formed with a circumferentially continuous annular surface 30 having compressionally loaded sealing coaction with an axially confronting formation of the wall of hub 15, within skirt 28; and the telescopically lapped adjacent surfaces of skirt 28 and flange 21 are configurated for fine-tooth ratchet or detent action. Suitably, the ratchet action derives from engagement between a continuous succession of axially extensive radially inward rib formations 28' in the bore of skirt 28, and a plurality of spaced axially extensive radially outward rib formations 29—29' on the periphery of the hub or flange 21. As shown, plural ribs 29 occur at angularly spaced groupings, with single ribs 29' in spaced interlace between groupings 29. The space between rib formations 29—29' will be understood to permit a degree of circumferential and radial accommodation in the course of ratcheting engagement with the inner ribs 28' of skirt 28, skirt 28 being thin enough to exhibit compliant transient deformation as necessary to adopt successive ratcheting engagements in the course of approach to the lowermost position of piston member 14.

Figure 3:
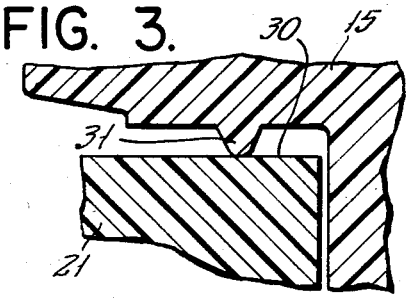
FIG. 3 is a further enlarged fragmentary sectional view of the seal of FIGS. 1 and 2.

FIGS. 2 and 3 are on a sufficiently enlarged scale to reveal the seal formation of piston hub 15 to be a single annular rib 31 of uniform section, depending from the inner radial wall of hub 15 and poised for circumferentially continuous axially compressed sealing engagement with surface 30, upon achieving the lowermost position of piston member 14. This seal action is effective due to the several ratchet-position escapements which occur in the course of compressionally loading the engagement, coupled with the annulus of contact attributable to compliant local flattening of rib 31 by reason of the axially loaded engagement.

Figure 4:
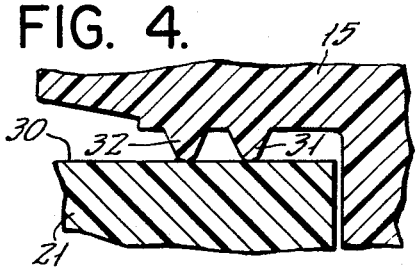
FIG. 4 is a view similar to FIG. 3, to show another seal embodiment.

In the arrangement of FIG. 4, the rib 31 is one of two concentric ribs 31–32 integrally formed with hub 15 for concurrent coaction with the confronting stem surface 30, thus establishing a double-seal engagement.

Figure 5:
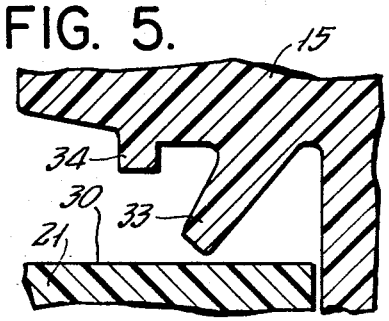
FIG. 5 is a view similar to FIG. 3, to show a further seal embodiment.

In the arrangement of FIG. 5, a frusto-conical lip 33 is an integral formation of piston hub 15, and a ring 34 depends integrally from hub 15 to provide extended length of the internal threads of hub 15. In the course of establishing seal closure, lip 33 is radially inwardly deflected via its abutment with surface 30.

Figure 6:
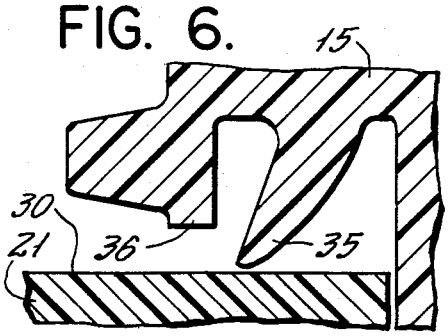
FIG. 6 is a view similar to FIG. 3, for a still further embodiment.

In the arrangement of FIG. 6, both a frusto-conical lip 35 and a thread-extending ring 36 are axially more extensive than in FIG. 5, the lip being contoured on its convex surface for broader-area seal contact. In the sealed position the seal lip 35 is inwardly deflected and compliantly stressed into axially loaded sealing contact with surface 30.

The described structures will be seen to meet all stated objects. Sealing effectiveness is in each case circumferentially continuous and axially preloaded, as well as being located so close to the threaded-engagement region as to effectively contain any hot filling liquid which may seep through the threads of the engagement. Strong axial preloading of the seal action is available by reason of the many ratchet positions per 360° of possible hub (15) to flange (21) angular relationships, there being several such engagements between the angular relation in which initial seal contact is made, and the final such engagement at which point the seal is axially preloaded and necessarily circumferentially continuous. Later on, long after a hardened stick has formed, a customer using the container will encounter only slight initial torsional resistance as the substance is propelled from the fully retracted position, the resistance being attributable to releasing escapement of the ratcheted engagement.

Typically, in a so-called two-ounce stick-deodorant container, the bore 11 of the housing is of 1.45-inch diameter, and the bore of skirt 28 is of 0.38-inch diameter. The plurality of radially inward ribs 28' in the bore of skirt 28 is 40, to a radial depth of 0.010-inch, and the unstressed radial interference with radially outward ribs 29—29' of similar radial depth is in the order of 0.004 to 0.005-inch; two rib groups 29 are diametrically opposed, in a plurality of nine ribs for each group, with diametrically opposed single ribs 29' in interlaced symmetry between groups 29, so that for each ratchet engagement twenty ribs of hub 21 engage in twenty of the forty spaces between adjacent ribs 28' in the bore of the skirt 28 of piston hub 15. Also, typically, there is at least one escaping ratchet engagement in the course of axially compressing the circumferentially sealed engagement, thus assuring that axial compression of the seal will hold, from the time of container manufacture, throughout the liquid-filling and solidifying process, and until the time of the customer's use of the loaded container.

While the invention has been described in detail for preferred embodiments, it will be understood that modifications may be made within the scope of the invention.

What is claimed is:

1. In a stick-deodorant or the like container, wherein a tubular housing with a cylindrical bore is closed at one end by a rotatable base-actuating member having a central threaded stem extending within said housing and on the axis of said bore, wherein a piston member has centrally threaded engagement with said stem and is externally configurated for circumferentially continuously sealed and axially stabilized piloting engagement with said bore, and wherein said stem and piston have ratcheting engagement to retain a lower-limit position of piston retraction within said housing, the improvement wherein at the location of ratcheting engagement said stem is characterized by a circumferentially continuous hub presenting a generally radial annular upper surface to the underside of said piston member, wherein the underside of said piston member integrally includes a downwardly projecting compliantly deformable skirt which axially overlaps at least part of said hub when said piston member is in its lowermost position, said skirt and hub having ratcheting formations which coact to retain one of a relatively large plurality of possible detent positions per single rotation of said threaded engagement, and the underside of said piston member integrally including within said skirt a circumferentially uniform and continuous downward relatively compliant projection that is radially localized for compressionally loaded and circumferentially sealed engagement with said annular surface when in ratcheted lower-limit position, whereby the sealed engagement can protect the ratchet engagement against fouling when the container is being filled with deodorant or the like cosmetic substance.

2. The improvement of claim 1, in which said base-actuating member and said piston member are each injection-molded of plastic material, the material of said piston member being more soft than that of said base-actuating member, whereby said projection may be deformed at contact with said annular surface.

3. The improvement of claim 1, in which said formations include a circumferential succession of axially extending radially inward ribs in the bore of said skirt, and axially extending radially outward ribs at spaced locations on the periphery of said hub.

4. The improvement of claim 1, in which said downward projection is a single annular rib of uniform section.

5. The improvement of claim 4, in which said rib is one of two concentric annular ribs, formed for concurrent circumferentially continuous sealing contact with said annular surface.

6. The improvement of claim 1, in which said downward projection is a generally frusto-conical compliant lip having interference engagement with said annular surface just prior to piston retraction to the ratcheted lower-limit position.

7. The improvement of claim 6, in which said piston member includes an annular circumferentially continuous abutment formation radially spaced from said downward projection and engageable with said annular surface to provide positive-stop location of the ratcheted lower-limit position.

8. The improvement of claim 6, in which the slope of said compliant lip is radially inward in the downward direction.

* * * * *